US011598196B2

(12) United States Patent
Younes et al.

(10) Patent No.: US 11,598,196 B2
(45) Date of Patent: Mar. 7, 2023

(54) UNIVERSAL RIG CONTROLLER INTERFACE

(71) Applicant: National Oilwell Vareo, L.P., Houston, TX (US)

(72) Inventors: Christian Younes, Leander, TX (US); Michael Mayerich, Liberty Hill, TX (US)

(73) Assignee: National Oilwell Varco, L.P., Houston, TX (US)

( * ) Notice: Subject to any disclaimer, the term of this patent is extended or adjusted under 35 U.S.C. 154(b) by 798 days.

(21) Appl. No.: 16/195,297

(22) Filed: Nov. 19, 2018

(65) Prior Publication Data

US 2020/0157927 A1 May 21, 2020

(51) Int. Cl.
*E21B 44/00* (2006.01)
*E21B 41/00* (2006.01)

(52) U.S. Cl.
CPC ..... *E21B 44/00* (2013.01); *E21B 41/0092* (2013.01)

(58) Field of Classification Search
None
See application file for complete search history.

(56) References Cited

U.S. PATENT DOCUMENTS 3,550,697 A 12/1970 Hobhouse
3,893,525 A 7/1975 Dower et al.
6,944,547 B2 9/2005 Womer et al.
7,026,950 B2 4/2006 Guggari et al.
7,321,175 B2 * 1/2008 Culpi ..... H02K 7/06 310/15
7,884,736 B2 2/2011 Jin et al.
8,079,569 B2 * 12/2011 Lesko ..... B66D 1/22 254/358
9,085,958 B2 7/2015 Laing et al.
9,163,497 B2 10/2015 Laing et al.
9,228,401 B2 1/2016 Edwards et al.
9,347,270 B2 5/2016 Shafer et al.
9,593,567 B2 3/2017 Pink et al.
2004/0195004 A1 10/2004 Power et al.
2009/0308603 A1 12/2009 Borgstadt
2015/0053482 A1 2/2015 Boone
(Continued)

FOREIGN PATENT DOCUMENTS

CA 3005535 A1 * 11/2019 ..... E21B 19/008
CN 204716222 U 10/2015
(Continued)

OTHER PUBLICATIONS

International Search Report dated Mar. 12, 2020, and issued in counterpart International Application No. PCT/US2019/061969.
(Continued)

*Primary Examiner* — Lina M Cordero
(74) *Attorney, Agent, or Firm* — Harris Wilson & Christenson PLLC

(57) ABSTRACT

A rig control interface includes a plurality of interface systems. Each of the interface systems is configured to manipulate a rig control based on a signal received from an automated rig control system. The interface systems includes a mechanical control interface. The mechanical control interface includes an actuator configured to mechanically move a control handle from a first position to a second position responsive to the signal.

25 Claims, 9 Drawing Sheets

(56) References Cited

U.S. PATENT DOCUMENTS

| | | | | |
|---|---|---|---|---|
| 2016/0031686 | A1* | 2/2016 | Kuttel | B66D 1/82 310/90 |
| 2018/0006684 | A1* | 1/2018 | Sawaf | E21B 47/12 |
| 2018/0156031 | A1 | 6/2018 | Tran et al. | |

FOREIGN PATENT DOCUMENTS

| | | | | |
|---|---|---|---|---|
| CN | 208662705 | U | * | 3/2019 |
| GB | 2295480 | A | | 5/1996 |
| RU | 2360862 | C2 | * | 7/2009 |
| WO | 2016102381 | A1 | | 6/2016 |
| WO | 2016149525 | A1 | | 9/2016 |

OTHER PUBLICATIONS

Qi, et al., "Design & Applicaiton of Digital Servo Band Brake Auto Driller on Rig," Jan. 2013, Retrieved from the Internet: URL: http://en.cnki.com.cn/Article_en/CJFDTOTAL-SKJX201301022.htm [Retrieved on Apr. 1, 2018].

* cited by examiner

UNIVERSAL RIG CONTROLLER INTERFACE

BACKGROUND

Rigs, such as drilling rigs or production rigs, used in exploration and production of oil and gas, apply a variety of tools and rig systems to implement the operations performed by the rig. For example, a drilling rig includes a draw works to raise and lower a drill string, a top drive or rotary table to rotate the drill string, pumps to circulate drilling fluid in the bore hole, and various other tools. The rig includes controls that an operator uses to manipulate the tools.

SUMMARY

A rig control interface includes a plurality of interface systems. Each of the interface systems is configured to manipulate a rig control based on a signal received from an automated rig control system. The interface systems includes a mechanical control interface. The mechanical control interface includes an actuator configured to mechanically move a control handle from a first position to a second position responsive to the signal.

A method for controlling a rig includes measuring, by an automated rig control system, a rig control parameter. Based on the measured rig control parameter, the automated rig control system, determines to change the value of the rig control parameter. A motor is activated, by the automated rig control system, responsive to the determining. Rotation of the motor is applied to mechanically move a control handle of the rig. A position of the control handle is measured by a sensor coupled to the control handle.

A method for automating control of a rig includes mounting a coupler on a mechanical control handle of a rig. Movement of the mechanical control handle changes a signal that controls a tool of the rig. An electric motor is connected to the coupler. An automated rig control system is electrically connected to the electric motor. A sensor that measures a value of a parameter of the tool is monitor by the automated rig control system. A control signal to change the value of the parameter of the tool is generated by the automated rig control system. The electric motor is activated responsive to the signal. The control handle is moved by the electric motor to change the value of the parameter of the tool.

BRIEF DESCRIPTION OF THE DRAWINGS

For a detailed description of various examples, reference will now be made to the accompanying drawings in which.

DETAILED DESCRIPTION

Figure 1:
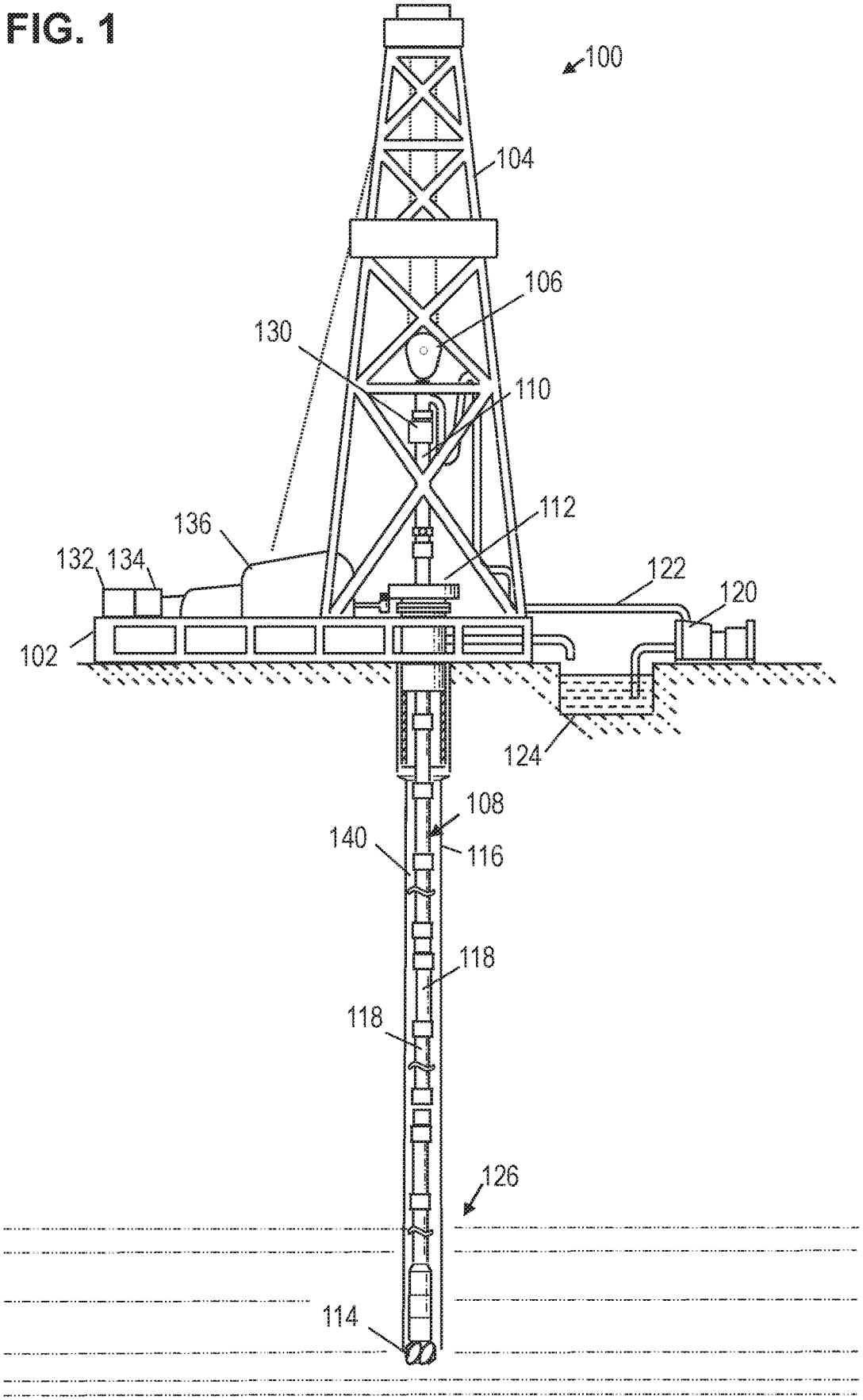
FIG. 1 shows an example rig that includes a universal rig interface in accordance with the present disclosure.

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections. The recitation "based on" is intended to mean "based at least in part on." Therefore, if X is based on Y, X may be a function of Y and any number of other factors.

Modern rigs include features that allow automated control of rig operations and implementation of variety of advanced control features, such as stick-slip mitigation, drilling optimization, drill pipe oscillation, etc. that can be implemented using automated control. Older rigs may not include automated control systems that allow for implementation of advanced control features. For example, older rigs may provide only manual control over the rig's tools which generally precludes the implementation of advanced control features. Consequently, in a competitive market, older rigs may suffer a significant disadvantage.

The rig control interface disclosed herein can be added to an older rig to provide an interface between the rig's tools and an automated control system. A rig that has been updated to include the rig control interface of the present disclosure can implement various advanced control features, which in turn, make the rig more desirable when compared with other rigs. Implementations of the rig control interface disclosed herein may include a mechanical control interface, an analog control interface, a pneumatic control interface, and/or a digital control interface each of which is coupled to an automated rig control system that controls the rig's tools via the rig control interface. The mechanical control interface mechanically manipulates, under control of the automated rig control system, a control handle, such as a rotary knob, a slider, or a switch, that controls a tool, e.g., a knob on an operator's console. The analog control interface selectively routes, under control of the automated rig control system, an analog control signal generated under the control of the automated rig control system to a tool controller, or routes an analog signal generated by a legacy rig control system to the tool interface. The pneumatic control interface selectively routes, under control of the automated rig control system, a pneumatic control signal generated under the control of the automated rig control system to a tool controller, or routes a pneumatic signal generated by a legacy rig control system to the tool interface. The digital control interface includes a digital control bus master that allows the automated rig control system to communicate with a tool controller via a digital control bus.

FIG. 1 shows an example rig 100 that includes a universal rig interface in accordance with the present disclosure. In the rig 100, a drilling platform 102 supports a derrick 104 having a draw works 136 for raising and lowering a drill string 108. A kelly 110 supports the drill string 108 as it is lowered through a rotary table 112. In some embodiments, a top drive is used to rotate the drill string 108 in place of the kelly 110 and the rotary table 112. A drill bit 114 is positioned at the downhole end of the tool string 126, and is driven by rotation of the drill string 108 or by a downhole motor (not shown) positioned in the tool string 126 up hole of the drill bit 114. The drill string 108 includes a plurality of lengths (or joints) of drill pipe 118 that are coupled end-to-end. As the bit 114 rotates, it removes material from the various formations and creates the borehole 116. A pump 120 circulates drilling fluid through a feed pipe 122 and downhole through the interior of drill string 108, through orifices in drill bit 114, back to the surface via the annulus 140 around drill string 108, and into a retention pit 124. The drilling fluid transports cuttings from the borehole 116 into the pit 124 and aids in maintaining the integrity of the borehole 116.

The rig 100 includes an automated rig control system 132 that provides automated control of various rig systems, such as the draw works 136, the rotary table 112 (or a top drive), and the pump 120. By controlling the operations of the various rig systems, the automated rig control system 132 can automate at least some drilling processes, and provide advance control functionality (such as stick-slip mitigation) that is generally possible only via automated control. The automated rig control system 132 interfaces with the various rig systems via a universal rig interface 134. The universal rig interface 134 couples the automated rig control system 132 to rig systems and translates control signals generated by the automated rig control system 132 to a form suitable for control of the rig systems. For example, in an implementation of the rig 100, the draw works 136, the rotary table 112, and/or the pump 120 may be controlled by mechanical manipulation of knobs, slider, switches, etc. (referred to herein as control handles) that are manually manipulated by an operator (i.e., a human user) to change an operation of the draw works 136, the rotary table 112, and/or the pump 120. Control means (such as control handles) provided in the rig 100 prior to inclusion of the universal rig interface 134 into the systems of the rig 100 are referred to herein as "legacy" controls. The universal rig interface 134 adapts the automated rig control system 132 to manipulate legacy controls of the rig 100, such as control handles. Legacy controls may take a variety of forms. In addition to control handles, the universal rig interface 134 may provide interfaces that allow the automated rig control system 132 to control rig systems via electrical analog control signals, pneumatic control signals, and/or a digital control bus.

Figure 2:
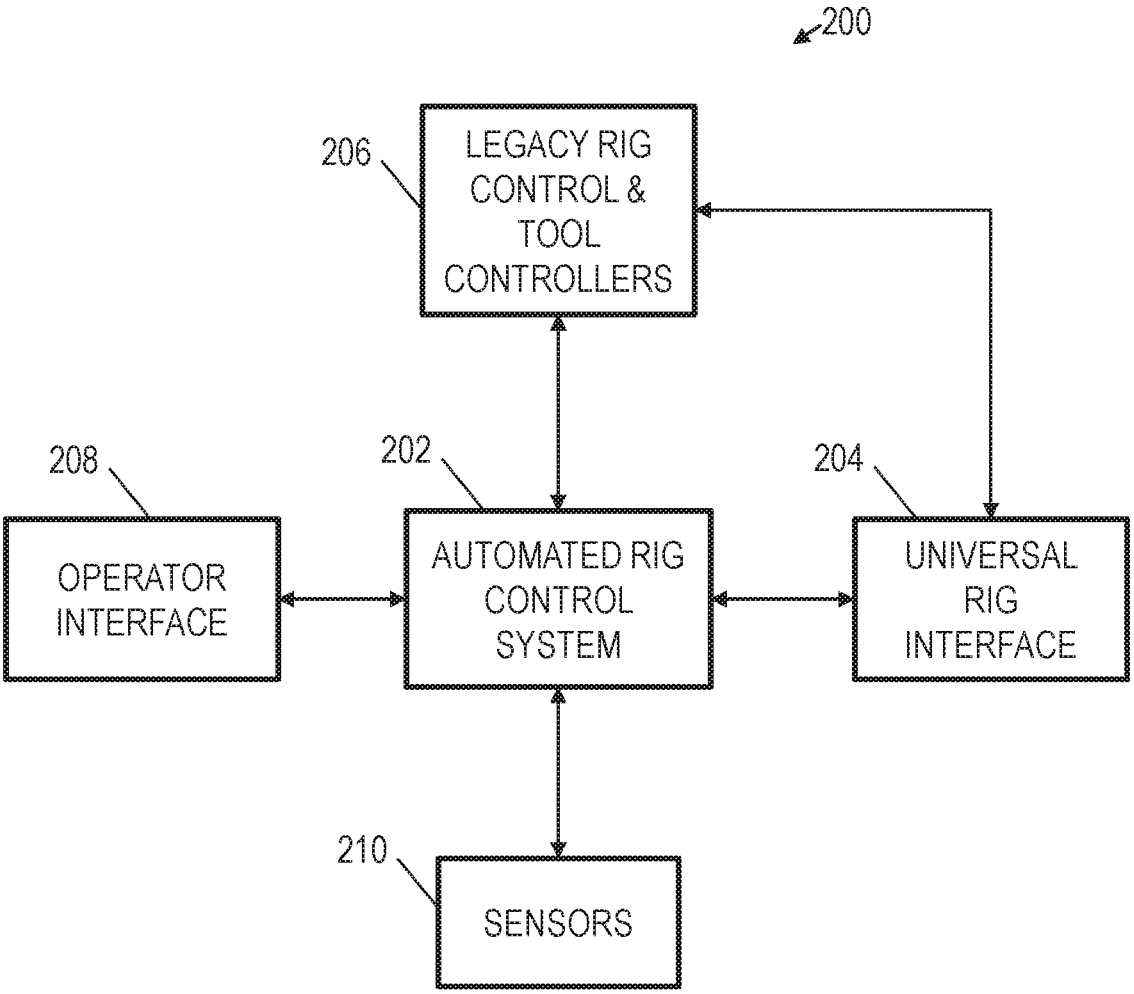
FIG. 2 shows a block diagram for an example of rig systems including a universal rig interface in accordance with the present disclosure.

FIG. 2 shows a block diagram for an example of rig systems 200 including a universal rig interface in accordance with the present disclosure. The rig systems 200 include an automated rig control system 202, a universal rig interface 204, legacy rig control and tool controllers, an operator interface 208, and sensors 210. The automated rig control system 202 is an example of the automated rig control system 132, and the universal rig interface 204 is an example of the universal rig interface 134. The automated rig control system 202 includes a processor, such as a microprocessor, a digital signal processor, etc. that executes instructions that cause the processor to monitor the operation of a rig's tools (e.g., the draw works 136, the rotary table 112, and/or the pump 120) and provide control signals that change the operation of the rig's tools. In some implementations, the automated rig control system 202 may be implemented using a computer or computing device as known in the art. The legacy rig control and tool controllers 206 includes the legacy controls of a rig (e.g., the rig 100) and tool controllers that directly control the rig's tools. For example, a tool controller for the electric motor of the draw works 136 may set the direction and amount of current flow to the electric motor to control the direction and speed of drum rotation. Tool controllers for the rotary table 112 (or a top drive) and the pump 120 may provide similar functionality. The legacy controls of the rig may include mechanical control handles, electrical analog signal generators, pneumatic signal generators, and/or a digital control bus.

The universal rig interface 204 translates control signals generated by the automated rig control system 202 to a form suitable for communication with the legacy rig control and tool controllers 206. For example, the universal rig interface 204 may translate digital signals generated by the automated rig control system 202 to mechanical motion or pneumatic signals to communicate with a tool controller via the legacy rig controls. In some implementations, the universal rig interface 204 translates signals from the legacy rig control and tool controllers 206 to a form suitable for input to the automated rig control system 202. For example, the universal rig interface 204 may translate physical position information for mechanical control handles or pneumatic signals from legacy rig controls to electrical signals suitable for input to the automated rig control system 202.

The sensors 210 measure operational parameters of the rig's tools and provide the measurements to the automated rig control system 202 for use in controlling the rig's tools. For example, the sensors 210 may measure the weight on the drill bit 114, which is a function of operation of the draw works 136, measure the rotation rate of the drill string 108, which is a function of the operation of the rotary table 112 or top drive, and/or measure the pressure of drilling fluid in the borehole 116, which is a function of the operation of the pump 120. The automated rig control system 202 may apply such measurements in execution of an automated control program to determine whether to adjust the operation of the rig's tools (e.g., to change the speed of the pump 120). The sensors 210 may include transducers in the drill string 108, on the draw works 136, on the pump 120, on the rotary table 112, and/or at other location of the rig 100 as needed to monitor and measure operation of the tools of the rig 100.

The operator interface 208 may include a display device, such as a computer monitor, or other device to communicate information from the automated rig control system 202 to an operator of the rig 100. The operator interface 208 may also include an input device, such as keyboard, a mouse, a trackball, a touchscreen, a microphone, etc. to allow an operator to provide control information to the automated rig control system 202. In some implementations, the operator interface 208 may be embodied in a computer or computing device as known in the art. The operator interface 208 may be located on-site with (i.e., at a same location as) the automated rig control system 202, or be remote (i.e., located at different site) from the automated rig control system 202.

Figure 3:
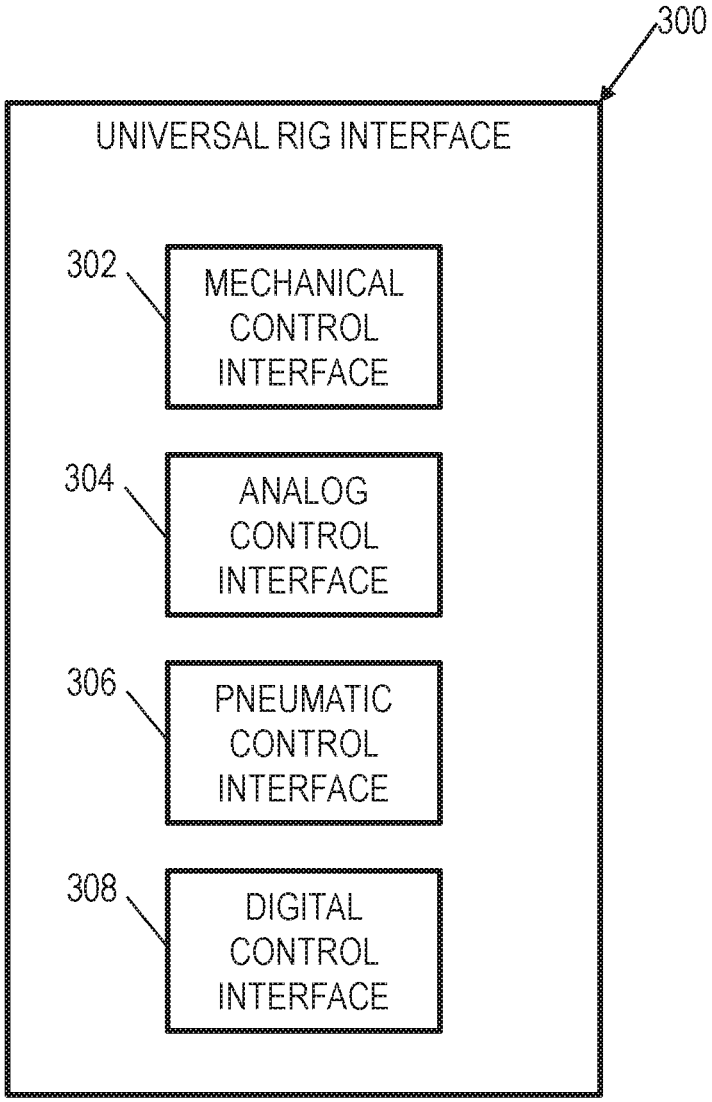
FIG. 3 shows a block diagram for an example of a universal rig interface in accordance with the present disclosure.

FIG. 3 shows a block diagram for an example of a universal rig interface 300 in accordance with the present disclosure. The universal rig interface 300 is an implementation of the universal rig interface 134 and/or the universal rig interface 204. The universal rig interface 300 includes one or more control interfaces. The implementation of the universal rig interface 300 shown in FIG. 3 includes four types of control interfaces, other implementations of the universal rig interface 300 may include a different number of types of control interfaces and/or may include more than one of each type of control interface. The universal rig interface 300 includes a mechanical control interface 302, an analog control interface 304, a pneumatic control interface 306, and a digital control interface 308. The mechanical control interface 302 interfaces the automated rig control system 132 to mechanical control handles, such as rotary knobs, linear sliders, or switches mounted on an operator control panel. The analog control interface 304 interfaces the automated rig control system 132 to a signal line that provides communication with a tool controller via a conductor carrying an analog electrical signal. The pneumatic control interface 306 interfaces the automated rig control system 132 to a pneumatic line that provides a pneumatic control signal to a tool controller. The digital control interface 308 interfaces the universal rig interface 134 to a digital control bus, such as Modbus or Profibus, which is used to communicate digital data, such as commands and parameters, to a tool controller.

Figure 4:
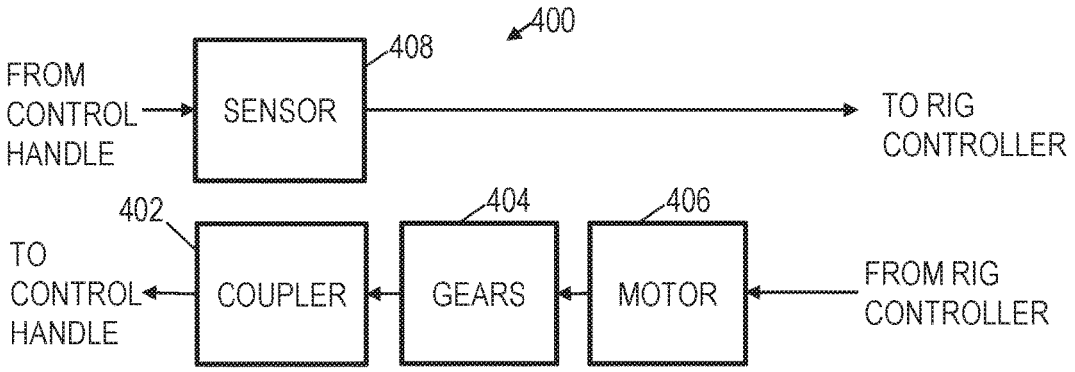
FIGS. 4-6 show block diagrams for example mechanical rig control interfaces in accordance with the present disclosure.
Figure 5:
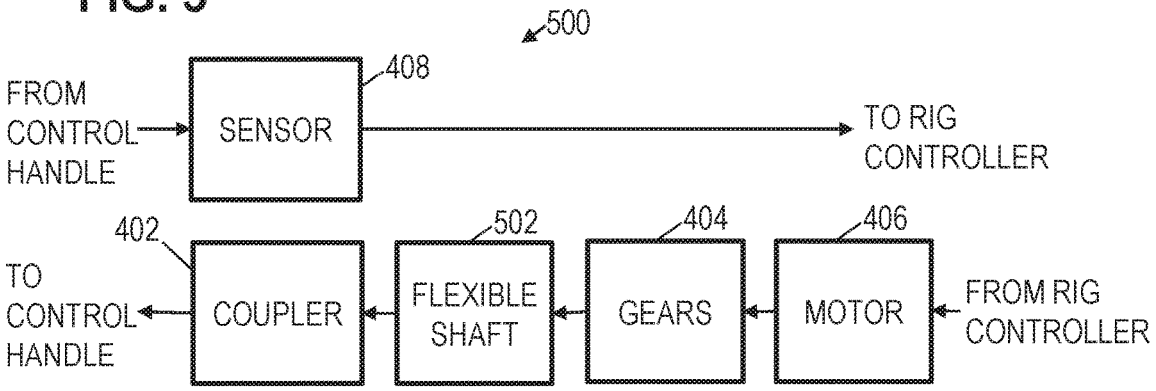
Figure 6:
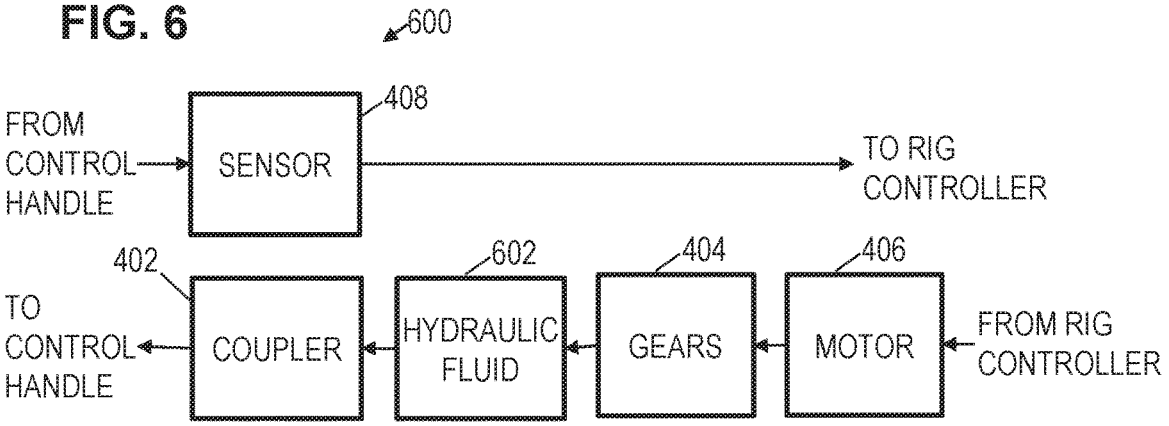

FIGS. 4-6 show block diagrams for example mechanical rig control interfaces in accordance with the present disclosure. FIG. 4 shows a block diagram for a first example of a mechanical control interface 400. The mechanical control interface 400 is an implementation of the mechanical control interface 302. The mechanical control interface 400 includes a coupler 402, gears 404, a motor 406, and a sensor 408. The coupler 402 engages a control handle of the legacy rig controls. For example, a surface of the coupler 402 may be in contact with a surface of the control handle so that rotational motion of the coupler 402 induces rotational motion in the control handle or linear motion of the coupler 402 induces linear motion of the control handle. That is, the coupler 402 adapts the control handle to be manipulated by operation of the motor 406. For example, if the control handle is a rotary knob, such as a rotary knob attached to a potentiometer or switch, the coupler 402 may include an engaging structure that retains the coupler 402 to the knob and a splined shaft that extends from the engaging structure. The engaging structure may include two plates that sandwich the knob (e.g., the plates connected by screws such that the plates exert pressure on a front side and a back side of the knob). The splined shaft extends from one of the plates, engages the gears 404, and is in-turn rotated by operation of the motor 406. In another implementation, the coupler 402 includes a boot or sheath formed of a flexible material (e.g., plastic) that securely fits over and engages the control handle. A splined shaft extends from the boot and engages the gears 404.

The gears 404 are driven by the motor 406, and in turn, drive the coupler 402. The gears 404 may provide a rotational output that is a fraction of the rotational rate of the motor 406. For example, a gear ratio of the gears 404 may produce an output rotation rate that $1/100^{th}$ of the rotation rate of the motor 406. Some implementations of the gears 404 may include a mechanism, such as a moveable rack or a slider-crank mechanism, which converts rotation to linear motion. The motor 406 is an actuator (such as a stepper motor) that rotates responsive to a control signal received from the automated rig control system 132. The control signal may indicate direction of rotation, speed of rotation, time of rotation, number of rotation cycles, etc. In some implementations, the gears 404 and the motor 406 may located on or at the legacy rig controls with the coupler 402 and the control handle manipulated by the mechanical control interface 400.

The sensor 408 senses the position of the control handle and provides a signal indicative of the position of the control handle to the automated rig control system 132. The sensor 408 may include a rotary encoder in some implementations of the mechanical control interface 400.

In some implementations of the mechanical control interface 400, the control handle may be manually manipulated by disengaging the coupler 402 from the control handle. For example, moving a knob (e.g., pushing or pulling) from a first position to a second position may disengage the coupler from the control handle and allow the control handle to be moved manually.

FIG. 5 shows a block diagram for a second example of a mechanical control interface 500. The mechanical control interface 500 is an implementation of the mechanical control interface 302. The mechanical control interface 500 is similar to the mechanical control interface 400, and includes a flexible shaft 502 coupled to the gears 404 and the coupler 402. The flexible shaft 502 transfers rotational force from the motor 406 and the gears 404 to the coupler 402. In implementations of the mechanical control interface 500, the motor 406 and the gears 404 may be isolated from the coupler 402, so that the likelihood of ignition in the vicinity of the coupler 402 caused by operation of the motor 406 is reduced. For example, the coupler 402 is disposed on or at the control handle (e.g., on a control panel), and the motor 406 is disposed in a first safe container.

FIG. 6 shows a block diagram for a third example of a mechanical control interface 600. The mechanical control interface 600 is an implementation of the mechanical control interface 302. The mechanical control interface 600 is similar to the mechanical control interface 500, and transfers force from the motor 406 and the gears 404 to the coupler 402 via hydraulic fluid 602. For example, the motor 406, through the gears 404, may drive a piston that moves the hydraulic fluid 602 in a tube coupling the gears 404 to the coupler 402. At the end of the tube proximate the coupler 402, movement of the hydraulic fluid induces motion (e.g., rotational or linear motion) of the coupler 402 to move the control handle. In implementations of the mechanical control interface 600, the motor 406 and the gears 404 may be isolated from the coupler 402, so that the likelihood of ignition in the vicinity of the coupler 402 caused by operation of the motor 406 is reduced.

Figure 7:
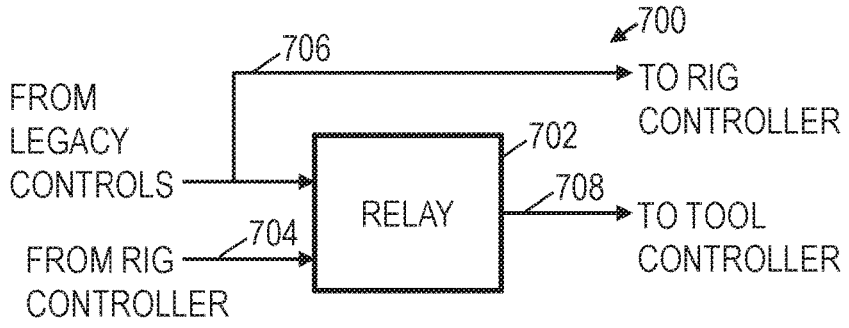
FIG. 7 shows a block diagram for an example analog control interface in accordance with the present disclosure.

FIG. 7 shows a block diagram for an example analog control interface 700 in accordance with the present disclosure. The analog control interface 700 is an implementation of the analog control interface 304. The analog control interface 700 includes a relay 702 that switches one of analog electrical control signal 704, provided by the automated rig control system 132, and an analog electrical control signal 706, provided by the legacy rig controls, to a tool controller. That is, the automated rig control system 132 may be coupled to a first terminal of the relay 702, the legacy rig controls coupled to a second terminal of the relay 702, and the tool controller coupled to a third terminal of the relay 702, wherein the relay 702 (e.g., under control of the automated rig control system 132) switchably connects the first terminal or the second terminal to the third terminal. The relay 702 may be implemented as an electromechanical device or a semiconductor device. Implementations of the analog control interface 700 may include additional components. For example, the analog control interface 700 may include a digital-to-analog converter to generate the analog electrical control signal 704 from a digital value provided by the automated rig control system 132, amplifiers, and other components. The analog control interface 700 may also route the analog electrical control signal 706 to the universal rig interface 134.

Figure 8:
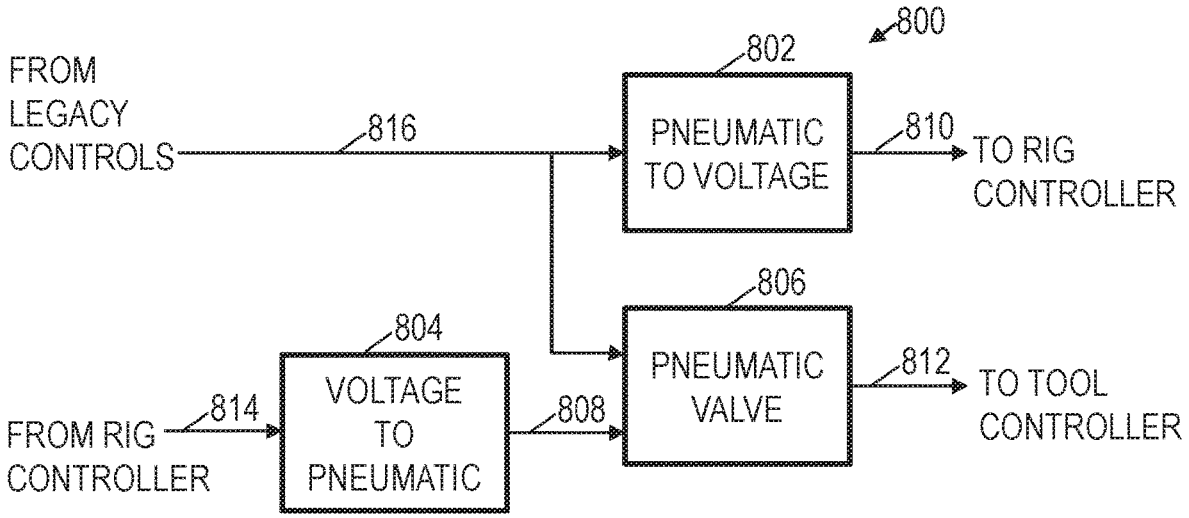
FIG. 8 shows a block diagram for an example pneumatic control interface in accordance with the present disclosure.

FIG. 8 shows a block diagram for an example pneumatic control interface 800 in accordance with the present disclosure. The pneumatic control interface 800 includes pneumatic-to-voltage converter 802, a voltage-to-pneumatic converter 804, and a pneumatic valve 806. The pneumatic-to-voltage converter 802 converts a pneumatic signal 816 provided by the legacy rig controls to an electrical signal 810 that is provided to the universal rig interface 134. The voltage-to-pneumatic converter 804 converts an electrical signal 814 provided by the universal rig interface 134 to a pneumatic signal 808. A first inlet of the pneumatic valve 806 is coupled to the legacy rig controls for receipt of the pneumatic signal 816, a second inlet of the pneumatic valve 806 is coupled to the voltage-to-pneumatic converter 804 for receipt of the pneumatic signal 808, and an outlet of the pneumatic valve 806 is coupled to a tool controller. The pneumatic valve 806 switchably routes (under control of the universal rig interface 134) the pneumatic signal 816 or the pneumatic signal 808 to the tool controller as the pneumatic signal 812.

Figure 9:
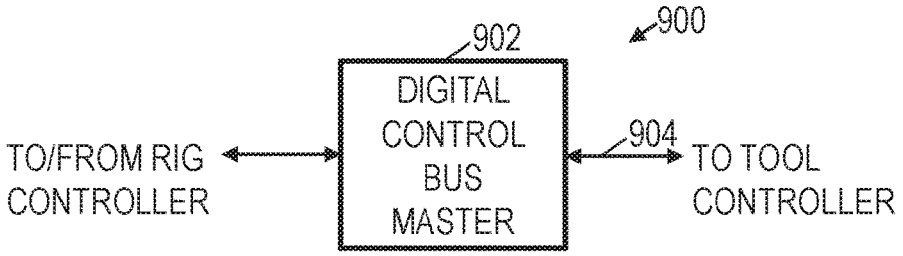
FIG. 9 shows a block diagram for an example digital control interface in accordance with the present disclosure.

FIG. 9 shows a block diagram for an example digital control interface 900 in accordance with the present disclosure. The digital control interface 900 includes a digital control bus master circuit 902. The digital control bus master circuit 902 is coupled to a digital control bus 904, and transfers information received from the automated rig control system 132 to a tool controller via the digital control bus 904. Similarly, the digital control bus master circuit 902 transfers information from the tool controller to the automated rig control system 132 via the digital control bus 904 in some implementations. The digital control bus 904 may be, for example, Profibus, Modbus, or other digital control bus.

Figure 10:
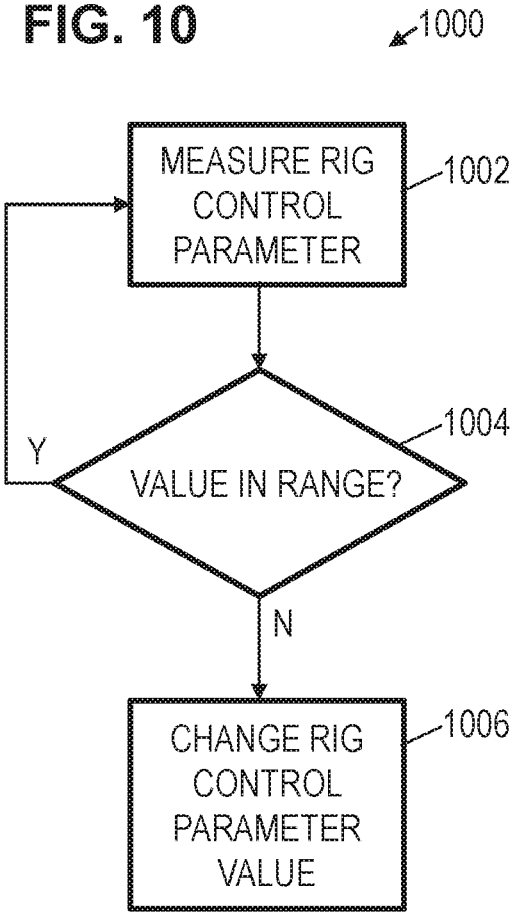
FIG. 10 shows a flow diagram for an example method for controlling a rig in accordance with the present disclosure.

FIG. 10 shows a flow diagram for an example method 1000 for controlling a rig in accordance with the present disclosure. Though depicted sequentially as a matter of convenience, at least some of the actions shown can be performed in a different order and/or performed in parallel. Additionally, some implementations may perform only some of the actions shown. Operations of the method 1000 may be performed by the automated rig control system 132.

In block 1002, the automated rig control system 132 receives a measurement value from a sensor 210 of the rig 100 that is related to a control parameter of the rig 100. The control parameter may specify, for example, rotation speed of the drill string 108, pressure of the drilling fluid in the 116, weight on the drill bit 114, or other control parameter of the rig 100.

In block 1004, the automated rig control system 132 compares the measured value to one or more threshold values or applies the measured value in a control algorithm to determine whether the value of the control parameter should be changed.

If the value of the control parameter is to be changed, then in block 1006, the automated rig control system 132 provides a signal to the universal rig interface 134, and the universal rig interface 134 translates the signal to a form suitable for use by the legacy rig controls of the rig 100. Further information regarding the operations performed by the universal rig interface 134 to translate the signal for use by the legacy rig controls of the rig 100 is provided in FIGS. 11-14.

Figure 11:
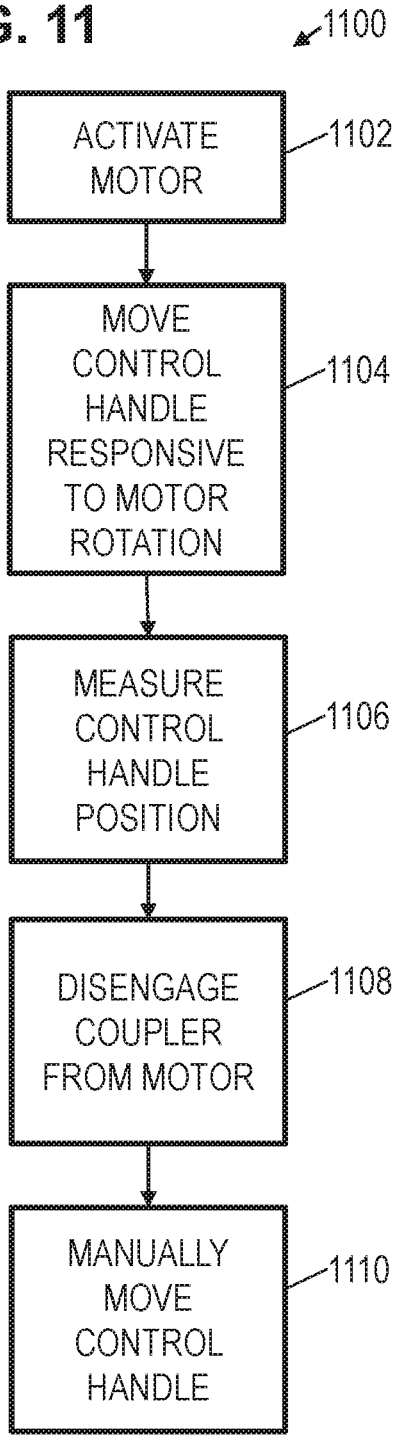
FIG. 11 shows a flow diagram for an example method for automated manipulation of a mechanical control handle for controlling a rig in accordance with the present disclosure.

FIG. 11 shows a flow diagram for an example method 1100 for automated manipulation of a mechanical control handle for controlling a rig in accordance with the present disclosure. Though depicted sequentially as a matter of convenience, at least some of the actions shown can be performed in a different order and/or performed in parallel. Additionally, some implementations may perform only some of the actions shown. Operations of the method 1100 may be performed by implementations of the mechanical control interface 302, including the mechanical control interface 400, the mechanical control interface 500, or the mechanical control interface 600.

In block 1102, the mechanical control interface 400 receives a signal from the automated rig control system 132 indicating that a legacy mechanical control handle of the rig 100 is to be moved. The signal may specify the direction, speed, and/or other parameters of motor operation. The mechanical control interface 400 activates the motor 406 to move the control handle.

In block 1104, rotation of the motor 406 induces movement of the gears 404, which in turn moves the coupler 402 and the control handle. In various implementations, force may be transferred from the motor 406 to the coupler 402 via the flexible shaft 502 or hydraulic fluid 602.

In block 1106, the sensor 408 measures the position of the control handle and transfers the measurement to the automated rig control system 132.

In block 1108, the coupler 402 is disengaged from the motor 406 to allow the control handle to be moved manually.

In block 1110, a rig operator manually moves the control handle.

Figure 12:
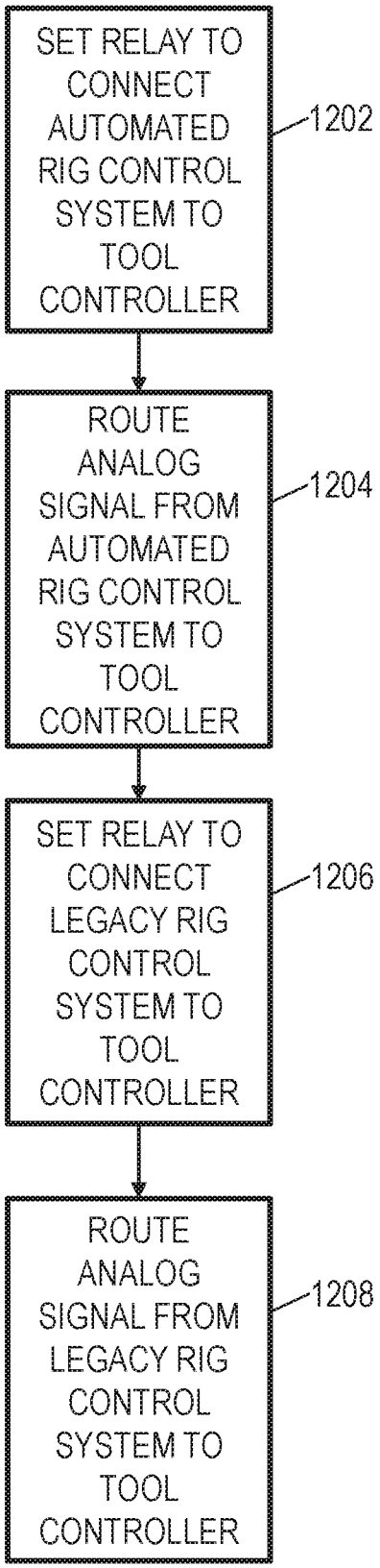
FIG. 12 shows a flow diagram for an example method for controlling a rig using an analog signal in accordance with the present disclosure.

FIG. 12 shows a flow diagram for an example method 1200 for controlling a rig using an analog signal in accordance with the present disclosure. Though depicted sequentially as a matter of convenience, at least some of the actions shown can be performed in a different order and/or performed in parallel. Additionally, some implementations may perform only some of the actions shown. Operations of the method 1200 may be performed by the analog control interface 700.

In block 1202, the automated rig control system 132 sets the relay 702 to connect an input terminal of the relay 702 that is coupled to the automated rig control system 132 to the output terminal of the relay 702, which is coupled to the tool controller.

In block 1204, the relay 702 routes the analog electrical control signal 704 provided by the automated rig control system 132 to the tool controller.

In block 1206, the automated rig control system 132 sets the relay 702 to connect an input terminal of the relay 702 that is coupled to a legacy rig control to the output terminal of the relay 702, which is coupled to the tool controller.

In block 1208, the relay 702 routes the analog electrical control signal 706 provided by the legacy rig control to the tool controller.

Figure 13:
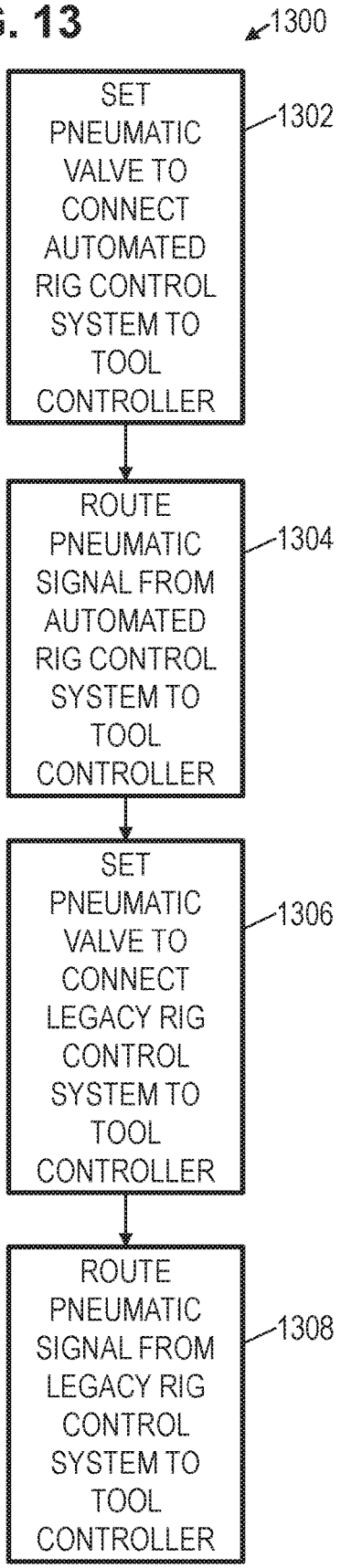
FIG. 13 shows a flow diagram for an example method for controlling a rig using a pneumatic analog signal in accordance with the present disclosure.

FIG. 13 shows a flow diagram for an example method 1300 for controlling a rig using a pneumatic signal in accordance with the present disclosure. Though depicted sequentially as a matter of convenience, at least some of the actions shown can be performed in a different order and/or performed in parallel. Additionally, some implementations may perform only some of the actions shown. Operations of the method 1300 may be performed by the pneumatic control interface 800.

In block 1302, the automated rig control system 132 sets the pneumatic valve 806 to connect an inlet of the pneumatic valve 806 that is coupled to the automated rig control system 132 to the outlet of the pneumatic valve 806 that is coupled to the tool controller.

In block 1304, the voltage-to-pneumatic converter 804 converts the electrical signal 814 provided by the automated rig control system 132 to the pneumatic signal 808, and the pneumatic valve 806 routes the pneumatic signal 808 to the tool controller.

In block 1306, the automated rig control system 132 sets the pneumatic valve 806 to connect an inlet of the pneumatic valve 806 that is coupled to a legacy rig control to the outlet of the pneumatic valve 806 that is coupled to the tool controller.

In block 1308, the pneumatic valve 806 routes the pneumatic signal 816 provided by the legacy rig control to the tool controller.

Figure 14:
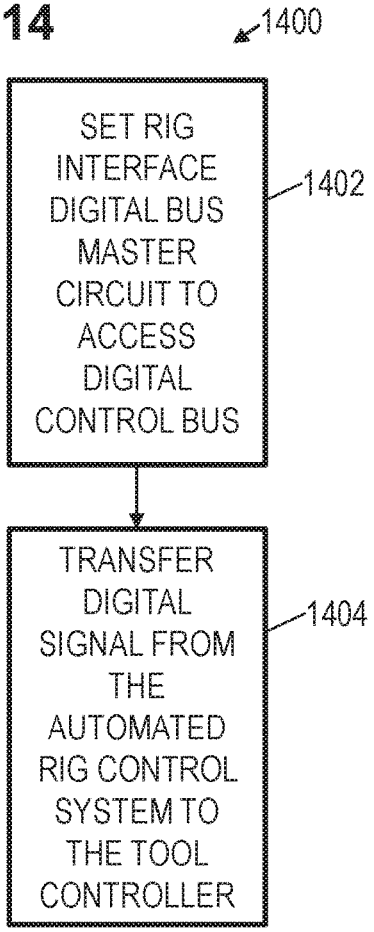
FIG. 14 shows a flow diagram for an example method for controlling a rig using a digital control bus in accordance with the present disclosure.

FIG. 14 shows a flow diagram for an example method 1400 for controlling a rig using a digital control bus in accordance with the present disclosure. Though depicted sequentially as a matter of convenience, at least some of the actions shown can be performed in a different order and/or performed in parallel. Additionally, some implementations may perform only some of the actions shown. Operations of the method 1400 may be performed by the digital control interface 900.

In block 1402, the automated rig control system 132 sets the digital control bus master circuit 902 to operate as a master device for accessing the digital control bus 904.

In block 1404, the digital control bus master circuit 902 transfers one or more digital values received from the automated rig control system 132 to the tool controller via the digital control bus 904.

Figure 15:
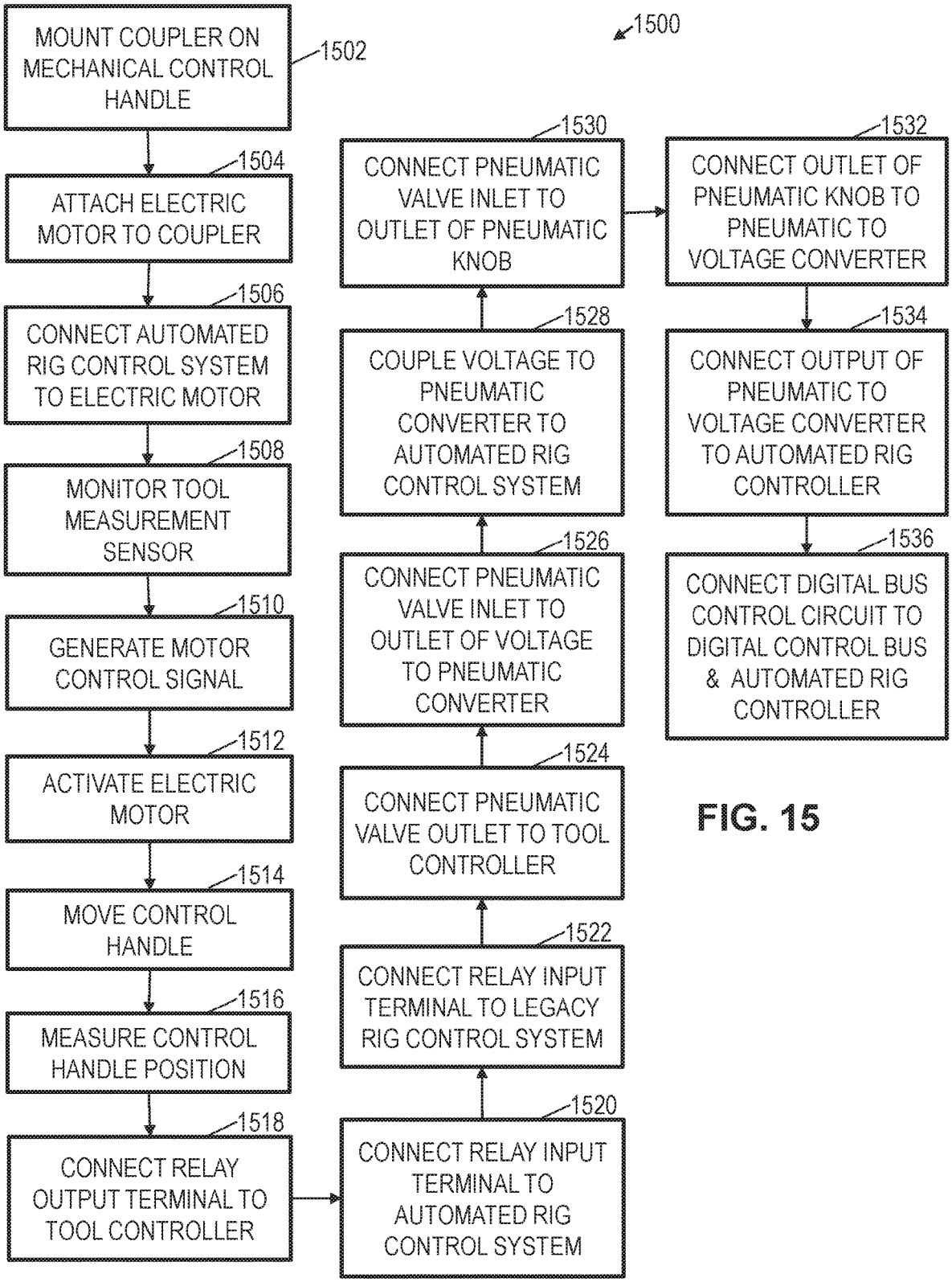
FIG. 15 shows a flow diagram for an example method for automating control of a rig using a universal rig interface in accordance with the present disclosure.

FIG. 15 shows a flow diagram for an example method 1500 for automating control of a rig using a universal rig interface in accordance with the present disclosure. Though depicted sequentially as a matter of convenience, at least some of the actions shown can be performed in a different order and/or performed in parallel. Additionally, some implementations may perform only some of the actions shown.

In block 1502, a coupler 402 is mounted to a control handle of a legacy rig control. The coupler 402 may engage a knob to rotate the knob, or engage a slider or switch to induce linear motion.

In block 1504, a motor 406 is attached to the coupler 402. Attachment of the motor 406 to the coupler 402 may be via the gears 404, the flexible shaft 502, and/or the hydraulic fluid 602.

In block 1506 the automated rig control system 132 is connected to the motor 406.

In block 1508, the automated rig control system 132 monitors a sensor 210 of the rig 100.

In block 1510, the automated rig control system 132 determines that a parameter of a tool controlled by the mechanical control interface 400 is to be changed, and generates an electrical control signal. The electrical control signal controls operation of the motor 406.

In block 1512, electrical control signal activates the motor 406.

In block 1514, rotation of the motor 406 moves the control handle via the coupler 402.

In block 1516, the sensor 408 measures the position of the control handle and provides the measurement to the automated rig control system 132.

In block 1518, an output terminal of the relay 702 is coupled to a tool controller.

In block 1520, a first input terminal of the relay 702 is coupled to the automated rig control system 132.

In block 1522, a second input terminal of the relay 702 is coupled to a legacy rig control.

In block 1524, a pneumatic outlet of the pneumatic valve 806 is connected to a tool controller.

In block 1526, a first pneumatic inlet of the pneumatic valve 806 is connected to the pneumatic outlet of the voltage-to-pneumatic converter 804.

In block 1528, the voltage-to-pneumatic converter 804 is electrically coupled to the automated rig control system 132.

In block 1530, a second pneumatic inlet of the pneumatic valve 806 is connected to a pneumatic outlet of a legacy rig control, such as an outlet of a pneumatic knob or switch.

In block 1532, the pneumatic outlet of a legacy rig control is connected to the pneumatic inlet of the pneumatic-to-voltage converter 802.

In block 1534, the pneumatic-to-voltage converter 802 is electrically coupled to the automated rig control system 132.

In block 1536, the digital control bus master circuit 902 is coupled to the digital control bus 904 and to the automated rig control system 132.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A universal rig control interface, comprising:

a plurality of interface systems, each of the plurality of interface systems configured to manipulate a rig tool based on a signal received from an automated rig control system, the plurality of interface systems comprising:

a mechanical control interface, comprising:

an actuator configured to mechanically move a control handle from a first position to a second position responsive to the signal; and a coupler comprising:

an engaging structure comprising:

a first plate and a second plate configured to exert pressure on a front side and a back side of the control handle, wherein the control handle is a knob mounted on an operator control panel; and a splined shaft extending from the first plate, the splined shaft configured to be rotated by the actuator.

2. The universal rig control interface of claim 1, wherein the coupler is configured to transfer force from the actuator to the control handle.

3. The universal rig control interface of claim 2, wherein the coupler is configured to allow manual manipulation of the control handle.

4. The universal rig control interface of claim 1, wherein the actuator is a stepper motor.

5. The universal rig control interface of claim 1, wherein the mechanical control interface further comprises a sensor configured to measure a position of the control handle.

6. The universal rig control interface of claim 1, wherein the mechanical control interface further comprises a flexible shaft coupled to the actuator and configured to transfer force from the actuator to the control handle.

7. The universal rig control interface of claim 1, wherein the mechanical control interface further comprises a hydraulic system coupled to the actuator and configured to transfer force from the actuator to the control handle.

8. The universal rig control interface of claim 1, wherein the actuator is mounted on the control handle.

9. The universal rig control interface of claim 1, further comprising an electrical analog control interface comprising a relay configured to:

while contacts of the relay are in a first position:

electrically connect the automated rig control system to a tool controller;

route a first analog control signal from the automated rig control system to the tool controller; and electrically isolate a legacy rig control system from the tool controller; and while contacts of the relay are in a second position:

electrically isolate the automated rig control system from the tool controller;

electrically connect the legacy rig control system to the tool controller; and route a second analog control signal from the legacy rig control system to the tool controller.

10. The universal rig control interface of claim 1, further comprising a pneumatic control interface, comprising:

a pneumatic valve configured to:

route a first pneumatic signal from the automated rig control system to a tool controller while the pneumatic valve is in a first position; and route a second pneumatic signal from a legacy rig control system to the tool controller while the pneumatic valve is in a second position.

11. The universal rig control interface of claim 1, further comprising a digital control interface comprising a digital control bus master configured to enable communication between the automated rig control system and a tool controller via a digital control bus.

12. A method for controlling a rig, comprising:

measuring, by an automated rig control system, a rig control parameter;

determining, by the automated rig control system, based on the measured rig control parameter, a change to a value of the rig control parameter;

activating, by the automated rig control system, a motor responsive to the determining;

applying rotation of the motor to mechanically move a control handle of the rig via a coupler that engages the control handle, wherein the coupler comprises:

an engaging structure comprising:

a first plate and a second plate configured to exert pressure on a front side and a back side of the control handle, wherein the control handle is a knob mounted on an operator control panel; and a splined shaft extending from the first plate, the splined shaft configured to be rotated by the motor; and measuring, by a sensor coupled to the control handle, a position of the control handle.

13. The method of claim 12, further comprising transferring force to the control handle via the coupler that engages the control handle.

14. The method of claim 13, further comprising:

disengaging the coupler from the motor; and manually moving the control handle.

15. The method of claim 12, further comprising transferring force from the motor to the control handle via a flexible shaft.

16. The method of claim 12, further comprising transferring force from the motor to the control handle via hydraulic fluid.

17. The method of claim 12, further comprising setting contacts of a relay to a first position that electrically connects the automated rig control system to a tool controller, and electrically isolates a legacy rig control system from the tool controller;

routing, with the contacts in the first position, a first analog control signal, via the relay, from the automated rig control system to the tool controller;

setting the contacts of the relay to a second position that electrically isolates the automated rig control system from the tool controller, and electrically connects the legacy rig control system to the tool controller; and routing, with the contacts in the second position, a second analog control signal, via the relay, from the legacy rig control system to the tool controller.

18. The method of claim 12, further comprising:

setting a pneumatic valve to route a first pneumatic signal from the automated rig control system to a tool controller;

providing the first pneumatic signal to the tool controller via the pneumatic valve;

setting the pneumatic valve to route a second pneumatic signal from a legacy rig control to the tool controller; and providing the second pneumatic signal to the tool controller via the pneumatic valve.

19. The method of claim 12, further comprising providing communication between the automated rig control system and a tool controller via a digital control interface and a digital control bus.

20. A method for automating control of a rig, comprising:

mounting a coupler on a mechanical control handle of the rig; wherein:

movement of the mechanical control handle changes a signal that controls a tool of the rig;

the mechanical control handle is a knob mounted on an operator control panel; and the coupler comprises:

an engaging structure comprising:

a first plate and a second plate configured to exert pressure on a front side and a back side of the knob; and a splined shaft extending from the first plate;

connecting an electric motor to the coupler, the motor configured to rotate the splined shaft;

connecting an automated rig control system to the electric motor;

monitoring, by the automated rig control system, a sensor that measures a value of a parameter of the tool;

generating, by the automated rig control system, a control signal to change the value of the parameter of the tool;

activating the electric motor responsive to the signal; and moving, by the electric motor, the mechanical control handle to change the value of the parameter of the tool.

21. The method of claim 20, further comprising measuring a position of the mechanical control handle by a second sensor attached to the coupler.

22. The method of claim 20, wherein connecting the electric motor to the coupler comprises connecting the electric motor to the coupler via a flexible shaft or hydraulic fluid.

23. The method of claim 20, further comprising:

connecting a first terminal of a relay to a conductor coupled to a tool controller;

connecting a second terminal of the relay to a conductor coupled to the automated rig control system; and connecting a third terminal of the relay to a conductor coupled to a legacy rig control.

24. The method of claim 20, further comprising:

connecting an outlet of a pneumatic valve to a pneumatic inlet of a tool controller;

connecting a first inlet of the pneumatic valve to an outlet of a voltage-to-pneumatic converter that is controlled by the automated rig control system;

connecting a second inlet of the pneumatic valve to an outlet of a pneumatic knob;

connecting a pneumatic-to-voltage converter to the outlet of the pneumatic knob; and connecting a voltage output of the pneumatic-to-voltage converter to the automated rig control system.

25. The method of claim 20, further comprising connecting a digital bus control circuit that is communicatively coupled to the automated rig control system to a digital control bus that is coupled to a tool controller.

* * * * *